US009027283B2

(12) United States Patent
Beyerle

(10) Patent No.: US 9,027,283 B2
(45) Date of Patent: May 12, 2015

(54) SLIDING DOOR

(71) Applicant: ABP Beverle GmbH, Bruchsal (DE)

(72) Inventor: Andreas Beyerle, Weingarten (DE)

(73) Assignee: ABP Beyerle GmbH, Bruchsal (DE)

( * ) Notice: Subject to any disclaimer, the term of this patent is extended or adjusted under 35 U.S.C. 154(b) by 0 days.

(21) Appl. No.: 13/894,342

(22) Filed: May 14, 2013

(65) Prior Publication Data

US 2013/0333292 A1 Dec. 19, 2013

(30) Foreign Application Priority Data

May 14, 2012 (DE) ..... 10 2012 009 500

(51) Int. Cl.

| | |
|---|---|
| ***E05D 13/00*** | (2006.01) |
| ***E05F 3/00*** | (2006.01) |
| ***E05F 5/00*** | (2006.01) |
| ***E06B 3/46*** | (2006.01) |

(52) U.S. Cl.

CPC ..... *E06B 3/4636* (2013.01); *E05F 3/00* (2013.01); *E05F 5/003* (2013.01); *E05Y 2201/212* (2013.01); *E05Y 2201/218* (2013.01); *E05Y 2800/672* (2013.01); *E05Y 2900/132* (2013.01)

(58) Field of Classification Search

USPC ..... 49/409, 410, 425, 449

See application file for complete search history.

(56) References Cited

U.S. PATENT DOCUMENTS

| | | | | |
|---|---|---|---|---|
| 1,940,971 | A * | 12/1933 | Schwartz et al. | 292/164 |
| 2,990,566 | A * | 7/1961 | Lee | 16/87 R |
| 4,872,287 | A * | 10/1989 | Block | 49/449 |
| 5,450,693 | A * | 9/1995 | Tarrega | 49/411 |
| 5,481,830 | A * | 1/1996 | Gooding et al. | 49/449 |
| 6,052,867 | A * | 4/2000 | Haab et al. | 16/87.6 R |
| 6,438,795 | B1 * | 8/2002 | Haab et al. | 16/85 |
| 6,516,575 | B2 * | 2/2003 | Haab et al. | 52/243.1 |
| 6,983,512 | B2 * | 1/2006 | De Oliveira | 16/97 |
| 7,325,847 | B1 * | 2/2008 | Tanner | 292/339 |
| 8,176,680 | B2 * | 5/2012 | Chubb et al. | 49/425 |
| 8,215,061 | B2 * | 7/2012 | Gosling et al. | 49/409 |
| 8,336,972 | B2 * | 12/2012 | Haab et al. | 312/322 |
| 8,375,638 | B2 * | 2/2013 | Martin et al. | 49/409 |
| 8,381,354 | B2 * | 2/2013 | Haab et al. | 16/91 |
| 8,402,606 | B1 * | 3/2013 | Tsai | 16/49 |
| 8,522,398 | B2 * | 9/2013 | Haab et al. | 16/105 |
| 2010/0242370 | A1 * | 9/2010 | Trulaske, Sr. | 49/410 |
| 2011/0126471 | A1 * | 6/2011 | Hans | 49/409 |
| 2011/0179718 | A1 * | 7/2011 | Martin et al. | 49/413 |
| 2012/0031008 | A1 * | 2/2012 | Martin et al. | 49/413 |
| 2012/0060419 | A1 * | 3/2012 | Riggs | 49/18 |

FOREIGN PATENT DOCUMENTS

| | | |
|---|---|---|
| DE | 103 50 810 | 6/2005 |
| DE | 10 2007 046 012 | 4/2009 |
| DE | 20 2007 015 807 | 4/2009 |
| DE | 10 2010 007 128 | 8/2011 |
| JP | 2007 182714 | 7/2007 |

* cited by examiner

*Primary Examiner* — Jerry Redman
(74) *Attorney, Agent, or Firm* — Klaus J. Bach

(57) ABSTRACT

In a sliding door with a door panel supported by a carriage disposed on a guide rail so as to foe movable between spaced door stops, the door stops include shock absorbers and the carriage has contact elements for contact with the shock absorbers. The shock absorbers further include return springs which are compressed by the engagement of the sliding door panel, the sliding door panel being lockable in its end positions by a locking arrangement for retaining it in an end position.

8 Claims, 7 Drawing Sheets

SLIDING DOOR

BACKGROUND OF THE INVENTION

The invention relates to a sliding door with at least one door panel which is supported by at least one carriage movably supported by a guide rail which is mounted to a wall or a ceiling. The guide rail is provided with at least one door stop with an abutment against which a contact element connected to the door panel is positioned in an end position of the door panel.

Such a sliding door wherein the door panel is formed by a glass pane is produced and sold by applicant. Above the door panel, the sliding door includes for example a horizontal guide rail which is mounted to a building wall and on which the door panel is supported by means of two carriages in longitudinally spaced relationship. The carriages are connected at their bottom, ends to the glass pane forming the sliding door. At the upper end of each carriage a support roller is rotatably supported which is so disposed on a guide rail that the door is movable along the guide rail from an open to a closed position. In this closed position, the door panel completely covers a door opening in the housing wall and, in the open position, the door panel is at the side of the door opening in front of the house wall. In order to prevent the carriages from being moved accidentally off the ends of the guide rail, a door stopper is attached adjacent the ends of the guide rail. The door stopper includes an abutment against which the carriage is positioned when the door panel is opened or closed. The known sliding door has been well accepted in practice particularly because of its attractive design wherein all parts of the sliding door including the carriage are visible. Still the sliding door does have some disadvantages. In particular, with a rapid opening or closing of the sliding door, the carriage rebounds somewhat so that the door is then not fully closed or fully open.

It is therefore the object of the present invention to provide a sliding door of the type as described above wherein however an undesired movement of the door out of the closed or open end positions is largely prevented.

SUMMARY OF THE INVENTION

In a sliding door with a door panel supported by a carriage disposed on a guide rail so as to be movable between spaced door stops, the door stops include shock absorbers and the carriage has contact elements for contact with the shock absorbers. The shock absorbers further include return springs which are compressed by the engagement of the sliding door panel, the sliding door panel being lockable in its end positions by a locking arrangement for retaining it in an end position.

The impact of the contact element on the door stop is dampened by the shock absorber which is pushed back and decelerates the door panel along the displacement path of the shock absorber without noise. When the door panel has been substantially or even fully stopped, a locking arrangement engages the shock absorber so that an accidental rebound of the door panel out of its end position is avoided. An engagement of the locking arrangement can occur at any point between the rest position of the abutment and the fully retracted position of the abutment. Preferably, the location where the locking arrangement locks is the farthest inward travel position of the abutment. But it is also possible that the locking arrangement is so designed that it engages at a location between the rest position of the abutment and its inward travel end position. In this case, the door panel is first decelerated to a standstill and then, for example, by the force of the return spring, moved a small distance in the opposite direction to the position in which it is locked by the locking device. The retaining force of the locking device is greater than the return force of the return spring so that the door panel, after being engaged by the locking device, remains in this position until it is moved by the user out of this locked position by applying an external force. Then the door panel can be moved easily by hand along the guide rail. The shock absorber comprises preferably a cylinder with an oil damped piston. The return spring is preferably integrated into the shock absorber housing. It may be a mechanical spring or a gas spring. The sliding door according to the invention is of simple design wherein all essential parts of the sliding door may be arranged so that they are easily visible.

In a preferred embodiment of the invention, the door stop includes a base part which is movable along the guide rail and which can be fixed to the guide rail at different locations, the shock absorber being disposed between the base part and the door panel abutment. The position where the door stop is arranged on the guide rail can then be adapted during installation of the sliding door by moving the base part along the guide rail in a simple manner depending on the local conditions and/or the wishes of the user of the sliding door. The adjustable connection between the doorstop and the guide rail can be established in a force- and/or form-locking manner.

In an advantageous embodiment of the invention, the locking arrangement on the base part includes a locking pin disposed at the side of the guide rail which is provided with at least one recess formed at the side thereof wherein the door panel includes a locking element which with the shock absorber being in an operating position, engages the recess in a direction transverse to extension of the guide rail in such a way that the door panel is arrested relative to the guide rail. The recess is preferably arranged, at the top side of the arresting pin and the locking element extends, in its locking position, into the opening from the top so that the locking element and the door panel connected thereto can be moved out of the locking position by slightly lifting the door panel. As a result of the force required for the lifting of the door panel and/or the carriage, an unintended movement of the door out of the locking position is prevented.

In a preferred embodiment of the invention, the arresting pin includes a first end area which is connected to the base part and a second end area which is spaced from the first area in the longitudinal direction of the guide rail and which can be pivoted out of its rest position elastically transverse to the direction in which the guide rail extends relative to the first end area. The second end area can then be pivoted out during engagement and disengagement of the locking element relative to the first end area transverse to the direction in which the guide rail extends. In this way, the locking arrangement can be operated with little friction.

It is advantageous if the engagement element or the recess has at least one inclined area in a vertical plane extending in, or parallel to, a longitudinal extension direction of the guide rail. The engagement element is then guided to, and retained at, the lowest point as soon as the inclined area of the engagement element reaches the recess and/or the inclined area of the recess comes into contact with the engagement element. As a result of this engagement function, the locking arrangement can be safely engaged even when the engagement element reaches the stop location at different speeds.

Expediently, the locking element is in the form of a catcher roller which is rotatable about an axis extending at a right angle with respect to the longitudinal direction of the guide rail. By means of the catcher roller, the locking arrangement can be operated with little friction. In addition, the catcher roller forms a visually attractive form of the locking arrangement.

The catcher roller is provided at its circumference with a concave recess in which the arresting pin is accommodated when the door panel is arrested relative to the guide rail. The catcher roller can then easily engage, and be locked in, the recess of the arresting pin and is centered on the arresting pin in the locking position in the direction of its axis.

In a preferred embodiment of the invention, the carriage includes at least one roller roiling on the guide rail which roller has a circumferential groove by which the guide rail is accommodated, the arresting pin being arranged closely below the guide rail so that it prevents the roller from being lilted out of the guide rail. With this feature, a jumping of the roller off the guide rail is prevented even during a hard impact of the stop element on the engagement member of the door stop.

The guide rail has preferably a cylindrical cross-section wherein the base part has a bore which is adapted to the cross-section of the rail which extends through the bore. In this way, an attractive design of the doorstop is obtained wherein the door stop forms optically a unit with the guide rail.

In an advantageous embodiment of the invention, the base part includes a dead end bore which extends parallel to the guide rail in which the cylinder of the shock absorber is at least partially fitted. The cylinder may be fixed in the dead end bore in a form- force- and/or material-locking manner.

The base part of the door stop has preferably a circular cylindrical outer surface which is arranged on the guide rail such that its cylinder axis extends transverse to the longitudinal center axis of the throughbore of the base part is spaced from the cylinder axis. That is, the base part is arranged asymmetrically with respect to the guide rail whereby in spite of the circular cylindrical form of the base part a compact doorstop is obtained.

Below the invention will be described in greater detail with reference to the accompanying drawings.

DESCRIPTION OF PARTICULAR EMBODIMENT

Figure 1:
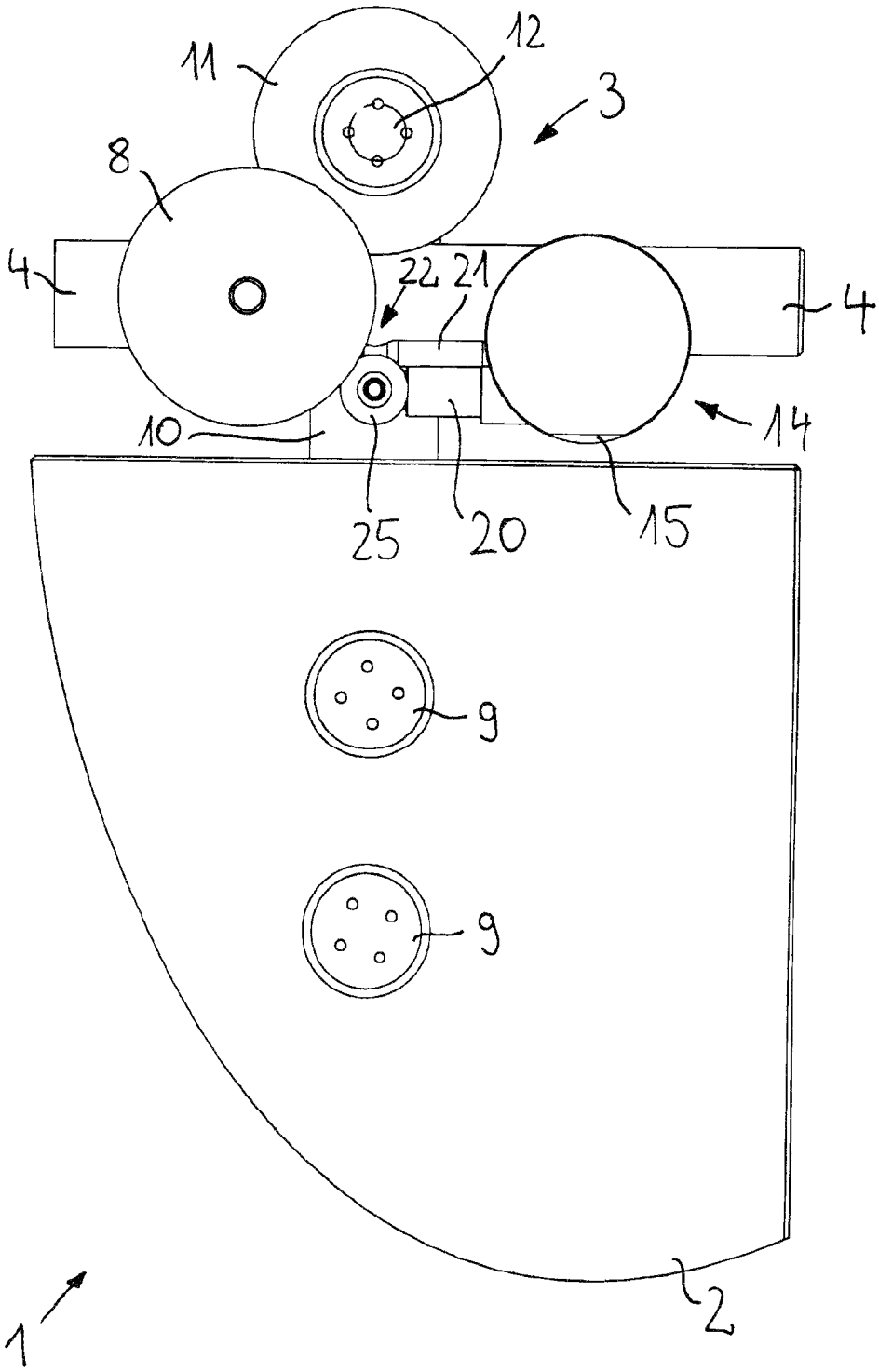
FIG. 1 shows a rear view of part of a sliding door consisting of a glass panel movably supported on a guide rail.

A sliding door as indicated in FIG. 1 by the numeral 1 comprises door panel 2 formed by a glass pane which is supported by means of two carriages 3 on a guide rail 4 so as to be movable horizontally back and forth between two end positions.

Figure 2:
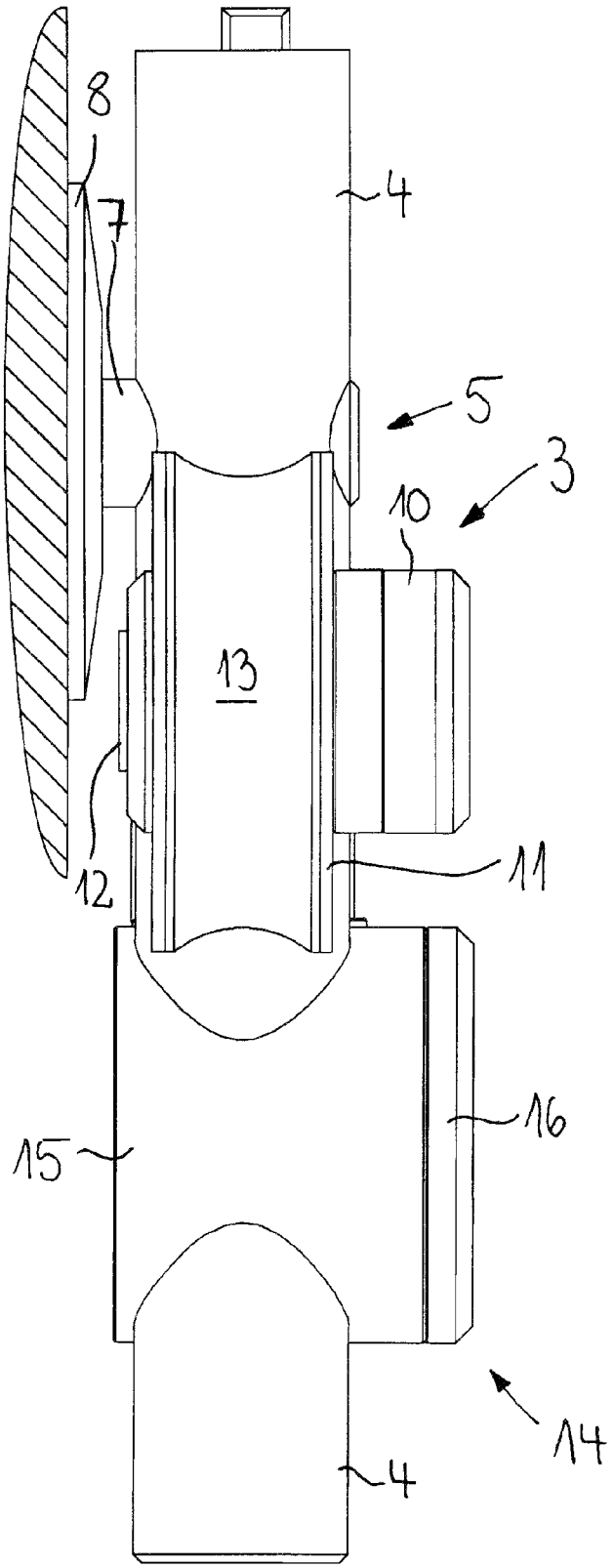
FIG. 2 is a top view of part of the sliding door wherein the guide rail and the door panel are shown only partially and also part of a house wall is shown on which the guide rail is mounted.
Figure 3:
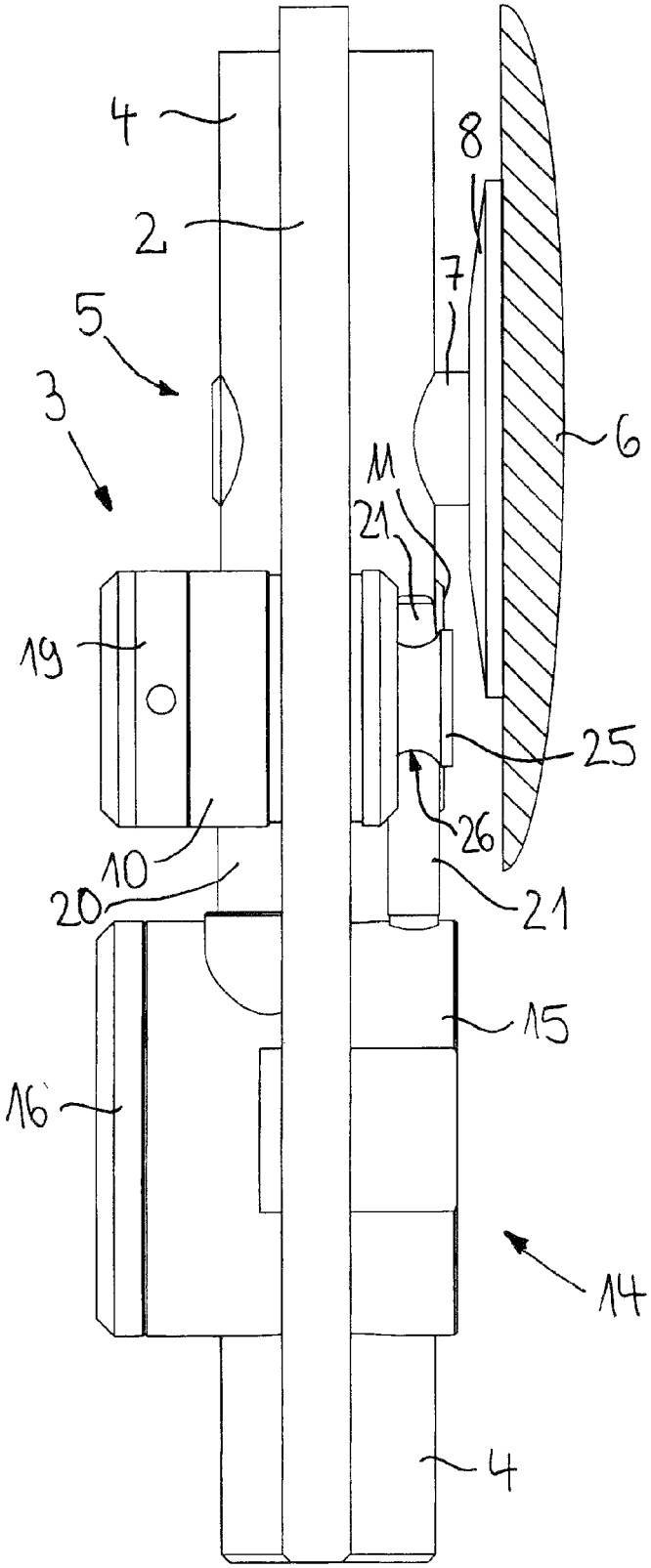
FIG. 3 is a bottom view of part of the sliding door wherein the guide rail and only part of the door panel in an end position thereof is shown.

The guide rail 4 has a circular cylindrical or tubular cross-section and is mounted to a building wall 6 by wall mounts 5 which are spaced from one another in the longitudinal direction of the guide rail 4. As shown in FIGS. 2 and 3, the wall mounts 5 comprise in each case a mounting bolt 7 which extends essentially normal to the wall surface and which is connected at its end remote from the guide rail 4 to a wall flange 8. The wall flange 8 is anchored to the building wall 6 for example by bolts or screws extending through the wall flange not shown in the drawings.

A section of each mounting bolt 7 spaced from the building wall 6 extends horizontally and transversely to the extension of the guide rail through an opening in the guide rail. The guide rail 4 is secured in its position by screws which are not shown in the drawings so as to prevent axial movement of the guide rail 4.

Below the guide rail 4, the door panel 2 is arranged about parallel to the surface of the building wall 6. The door panel 2 is mounted to the carriages 3 by screw elements which extend through fitted openings in the glass pane and are screwed to the carriages 3. The carriages 3 are spaced from each other in the longitudinal direction of the guide rail 4 and arranged adjacent the side edges of the door panel 2.

Figure 4:
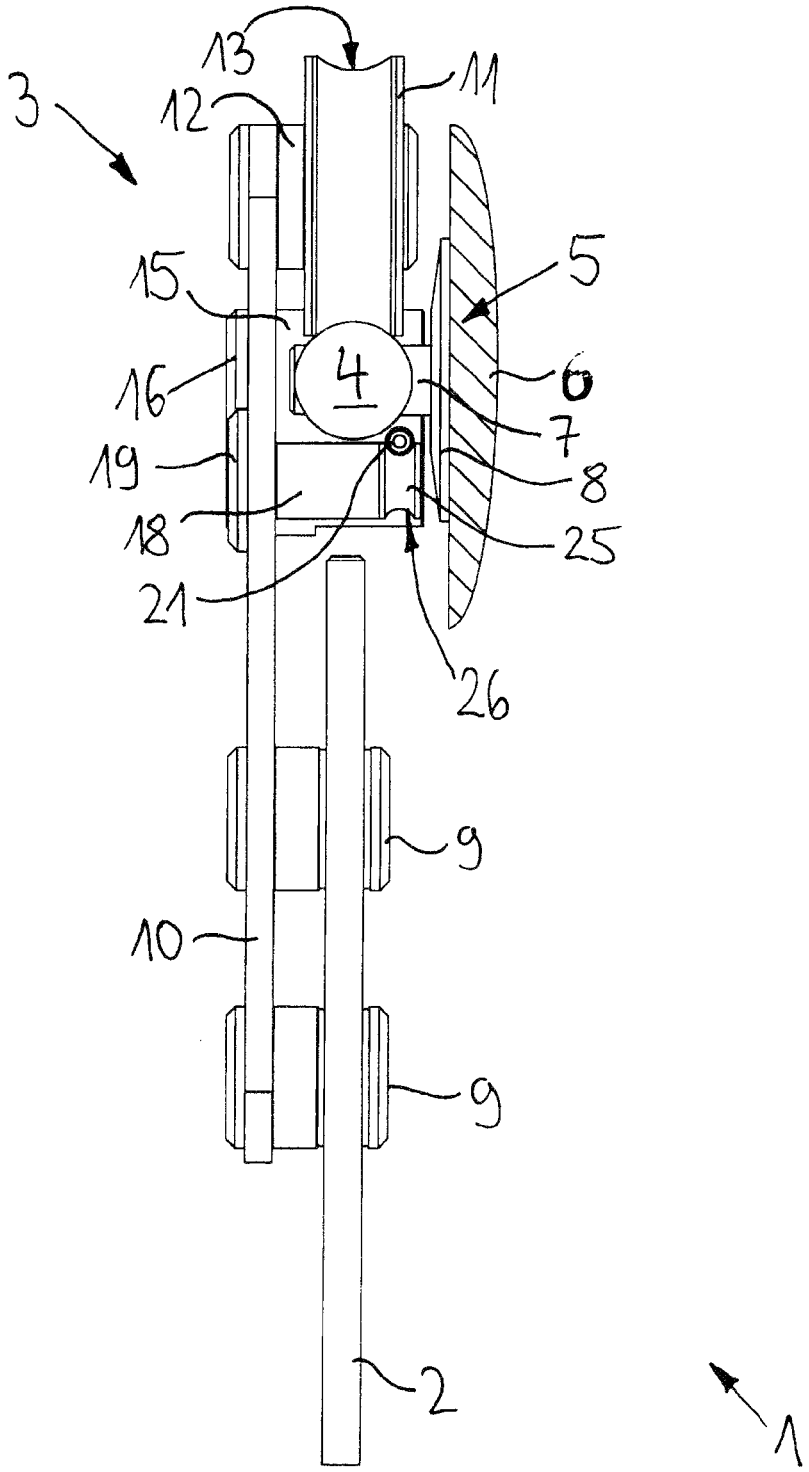
FIG. 4 is a side view of an upper part of the sliding door together with a carriage on which the sliding door is supported.
Figure 5:
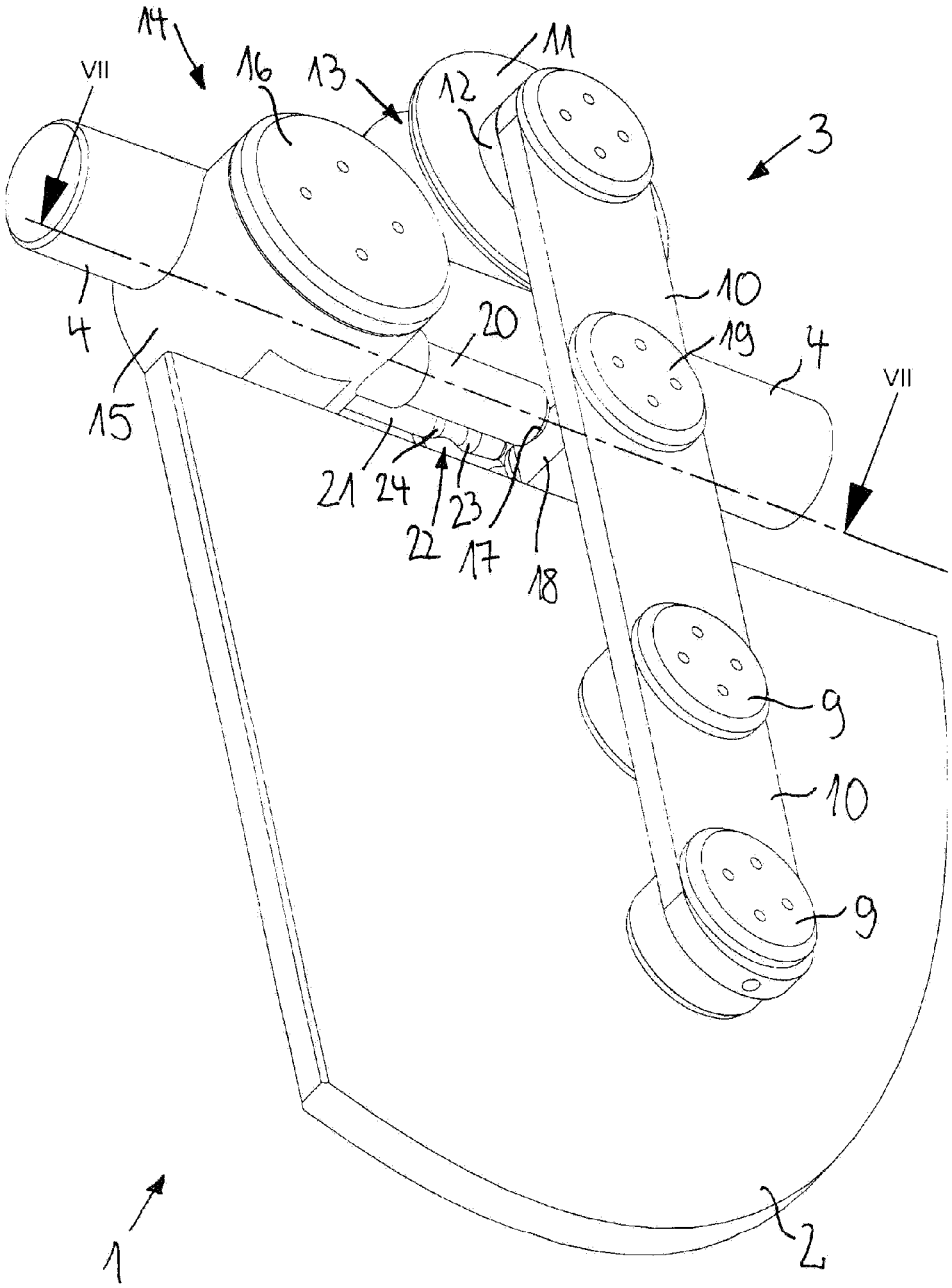
FIG. 5 is a partial perspective view of the front side of the sliding door showing the carriage and a door stopper connected to the guide rail spaced from the carriage.

FIGS. 4 and 5 show that each carriage 3 includes a vertically extending carrier member 10 which at its lower end is screwed to the door panel 2 by screw elements 9 and, at its upper end carries a support roller 11.

The support roller 11 of each carriage 3 is rotatably supported by a horizontal shaft 12 which is mounted to the carrier member 10 of the respective carriage 3 and which is arranged, in a top view, to extend at a right angle with respect to the longitudinal direction of the guide rail 4. As apparent particularly well from FIG. 2, the support rollers 11 are provided at their circumference with concave channels 13, that is, radial circumferential recesses by which the guide rail 4 is accommodated. The radius of the concave recess corresponds to the radius of the guide rail or is slightly larger than that of the guide rail. By means of the channel 13, the support roller 11 is centered on the middle of the guide rail 4. On both sides, the support roller extends over the guide rail 4 (FIG. 4).

Adjacent each end of the guide rail 4 a door stop 14 is mounted to the guide rail. The stop has a cylindrical surface and a center axis which extends normal to, but somewhat below, the longitudinal center axis of the guide rail 4, which passes through the bore. At its bottom, the base part 15 has a flattened area which forms a recess with respect to the cylindrical surface of the base part and which is disposed above the door panel 2. The flattened area extends parallel to the top edge of the door panel 2.

At the side facing away from the building wall, the base part 15 is closed by an ornamental screw 16 whose head completely covers the front side of the base part 15. Behind the screw head, the base part 15 includes a threaded bore which, is not shown in the drawing but in which a clamping screw is disposed for locking the bass part 15 to the guide rail 4. With the clamping screw loosened, the base part 15 can be moved along the guide rail 4.

Figure 6:
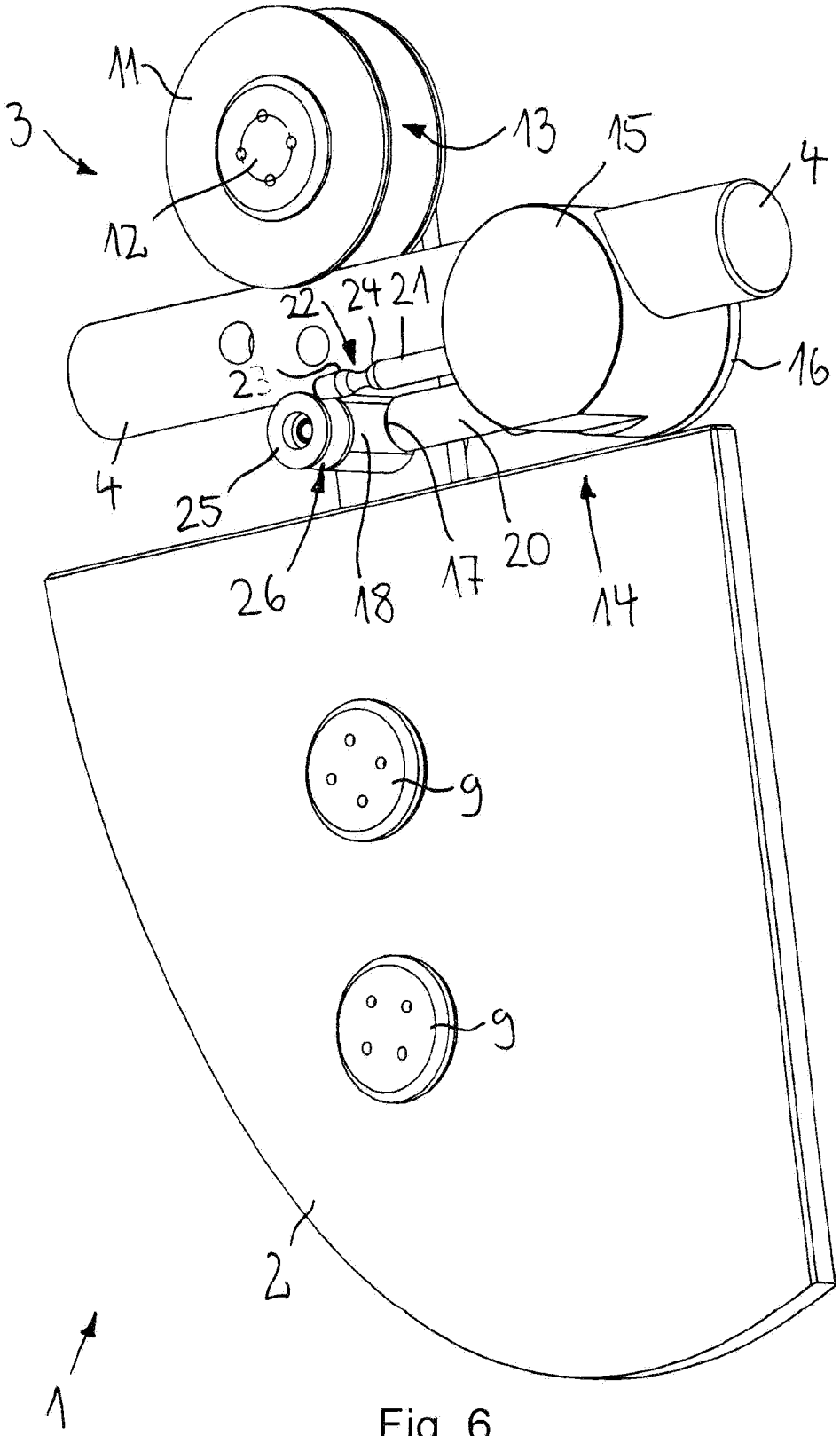
FIG. 6 is a partial perspective view of the backside of the sliding door showing the carriage and the door stop with a catching roller of the carriage arranged, ahead of the door stop.

The doorstop 14 has a stop area 17 which is engaged by an engagement element 18 arranged on the carrier 10 of the carriage when the door panel is in its end position adjacent the respective door stop 14. As shown in FIGS. 5 and 6, the engagement element 18 is disposed between the door panel 2 and the guide rail 4. The engagement element 13 is firmly connected to the carrier 19 and screwed thereto by a screw 19.

At its side facing the stop area 17, the engagement element 18 has a flattened surface area which in the end position of the door panel 2 at the door stop 14 abuts the stop area 17.

Figure 7:
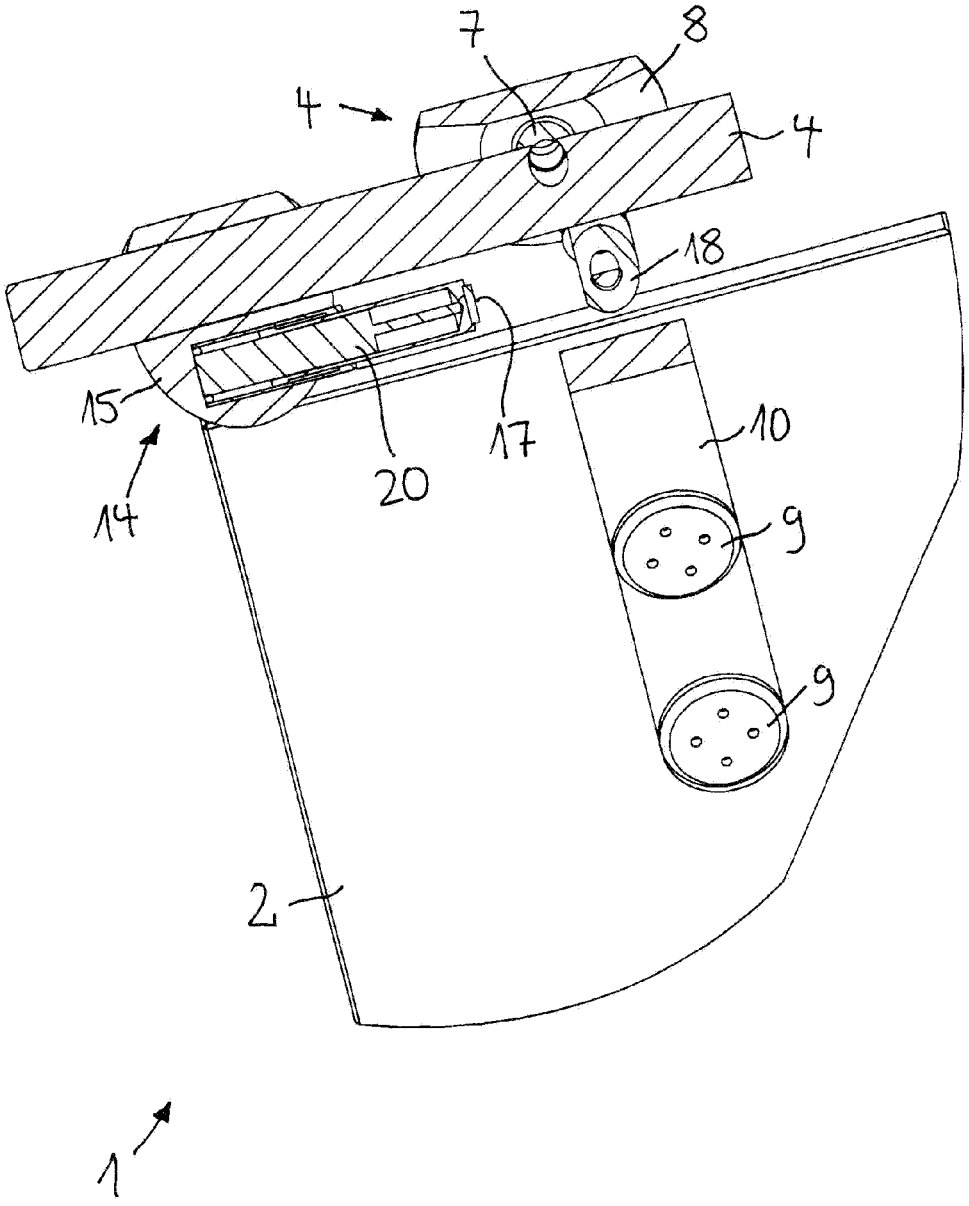
FIG. 7 is a view similar to FIG. 5 wherein however some parts of the sliding door are shown in cross-section as indicated in FIG. 5 by the plane marked VII.

The stop area 17 is supported on the base part 15 by a hydraulic shock absorber 20. The shock absorber 20 is shown in FIG. 7 only schematically. It includes in a well-known manner, an oil-filled cylinder part in the interior of which a piston is axially movably supported. It is connected to the stop area by means of a piston rod. The shock absorber 20 is so designed that, upon axial movement of the piston and the piston rod, oil in the cylinder must flow through narrow channels or valves in the piston. The flow resistance occurring in the process generates pressure differences at the piston which generate damping forces which slow down the door panel and the carriages attached thereto, when the engagement element 18 of the carriage 3 reaches the stop area 17 of the shock absorber 20. In order to dampen the impact, the shock absorber 20 is provided at the stop area 17 with a layer of an elastic material such as rubber platelets.

The shock absorber 20 additionally includes a return spring, which is not shown in the drawings, by the return force of which the piston is moved out of an end position adjacent the bottom of the cylinder part into an operating position in which the piston is spaced from the bottom of cylinder part. Accordingly, the shock absorber 20 has in its rest position, a greater length than in its end position. The return spring may be a mechanical spring or a pressurized gas spring wherein gas is enclosed in part of the cylinder interior.

FIG. 7 shows that the base part 15 includes a dead end bore which extends parallel to the guide rail, and which is sized to accommodate the shock absorber 20 and receives the cylinder part thereof. It is clearly visible that the shock absorber 20 is arranged with its longitudinal axis extending parallel to the longitudinal axis which extends parallel to the longitudinal direction of the guide rail 4.

When the carriage 3 is disposed with its engagement element 18 in contact in the stop area 17 and the shock absorber 20 is compressed or respectively, in its operating position, the door panel 2 is in its end position at the respective door stop 14. The door panel is then locked to the guide rail 4 by means of a locking arrangement.

As clearly shown in FIG. 6, the locking arrangement includes a locking pin 21 which projects from the side of the base part 15 and which extends parallel to the guide rail 4 and has at its outer circumferential surface an annular groove 22. The groove 22 is disposed between two essentially cylindrical sections of the locking pin 21 and is provided at both sides of the deepest area thereof with inclined flanks 23, 24 which extend in each case from the deepest area to the adjacent cylindrical sections of the locking pin 21. The section of the locking pin 21 between the groove 22 and the free end of the locking pin 21 may be conical. The locking pin 21 may also be conical becoming narrower toward its free end.

The locking arrangement further includes an engagement element 25 in the form of a catch roller which when the shock absorber 20 is in its operating position engages in the annular groove 22 of the locking pin 21 so that the carriage 3 with the door panel 2 is locked to the guide rail 4 (FIGS. 1 and 4). The engagement element 25 is supported by the engagement element 18 so as to be refutable about an axis extending parallel to the axis of rotation of the support roller 11.

In the locking position as shown in FIG. 1, the locking arrangement, by the application of a force to the door panel 2 in a direction parallel to the guide rail 4 and away from the door stop 14, can be released from the locking position. In the process, the engagement element 25 rolls over the inclined flank 23 to the free end of the locking pin 21 whereby the carriage 3 and the door panel mounted thereon are raised according to the depth of the groove 22. The force required for the unlocking of the locking arrangement is greater than the return force of the return spring of the shock absorber 20.

FIG. 6 shows that the engagement element 25 has a circumferential concave groove 26 for receiving the locking pin 21 in its operating position. With the concave groove 26, the engagement element 25 is centered in the direction of its axis of rotation on the locking pin 21.

FIG. 4 shows that the locking pin 24 is disposed closely below the guide rail 4 so that the support roller 11 cannot be lifted off the guide rail 4. When the support roller 11 is seated on the guide rail 4, the vertical distance between the locking pin 21 and the guide rail 4 is smaller than the depth of the concave channel 13 of the support roller 11.

What is claimed is:

1. In a sliding door (1) with a door panel (2) supported by at least one carriage (3) disposed on, and guided by, a guide rail (4) so as to be movable between two end positions, the guide rail (4) being mountable to a wall or ceiling and including at least one door stop (14) including a stop area (17) and the door panel (2) being provided with an engagement element (18) for abutting the stop area (17) in an end position of the door panel (2), the improvement, wherein the doorstop (14) is a cylindrical body with a center axis and a bore which extends through the cylindrical body offset from the center axis with the guide rail (4) extending through the bore and door stop (14) being lockable to the guide rail (4), the door stop (14) further having incorporated therein a hydraulic or pneumatic shock absorber (20) by way of which the stop area (17) is propped against the guide rail (4), the shock absorber (20) including a return spring by the return force of which the shock absorber (20) is biased out of an end position into an extended position and the door panel (2) is lockable relative to the guide rail by a locking arrangement mounted on the door stop (14) including a locking pin (21) with at least one side recess (22) and the carriage (3) being provided with an engagement element (25) including an engagement roller (25) which is rotatably supported by a shaft which extends from the carriage (3) at a right angle to the longitudinal direction of the guide rail (4), and which is provided with a circumferential groove of concave cross-section into which the locking pin (21) engages with its side recess (22) whereby the door panel (2) is retained in position relative to the guide rail (4).

2. The sliding door according to claim 1, wherein the door stop (14) is slidably supported by the guide rail (4) and lockable to the guide rail (4) at different locations, the locking arrangement including a threaded bore formed in the door stop (14) and including a clamping screw covered by an ornamental plate screw (16).

3. The sliding door according to claim 2, wherein the locking pin (21) includes a first end area which is connected to the door stop (14) and a second end area which is spaced from the first end area in the longitudinal direction of the guide rail (4) and which is pivotable elastically out of a rest position in a direction transverse to the longitudinal direction of the guide rail (4) relative to the first end area.

4. The sliding door according to claim 1, wherein the recess (21) of the engagement element (25) includes at least one wall area which is inclined with respect to a vertical plane extending parallel to a longitudinal direction of the guide rail (4).

5. The sliding door according to claim 1, wherein the carriage (3) includes at least one support roller (11) which is supported on the guide rail (4) and is provided at its circumference with a concave channel (13) in which the guide rail (4) is accommodated and the locking pin (21) is disposed closely below the guide rail (4) to prevent the support roller (11) from being lifted off the guide rail (4).

6. The sliding door according to claim 1, wherein the guide rail (4) has a circular cross-section and the door stop (14) has a bore which is sized to accommodate the guide rail (4) and through which the guide rail (4) extends.

7. The sliding door according to claim 6, wherein the door stop (14) further includes a dead end bore extending parallel to the guide rail (4) and the shock absorber (20) is in an form of a damping cylinder with a cylinder part fitted into the dead end bore and is disposed at least partially in the dead end bore.

8. The sliding door according to claim 6, wherein the door stop (14) has a cylindrical surface having a cylinder axis extending transverse to a longitudinal direction of the guide rail (4) and the longitudinal center axis of the bore in the door stop (14) extends at a distance from the cylinder axis.

* * * * *